United States Patent [19]

Reed et al.

[11] Patent Number: 4,620,698

[45] Date of Patent: Nov. 4, 1986

[54] ORTHOPEDIC SUPPORT DEVICE

[75] Inventors: Albert D. Reed, Greenwood, S.C.; Paul E. Sottak, Laconia, N.H.

[73] Assignee: Professional Medical Products, Inc., Greenwood, S.C.

[21] Appl. No.: 707,886

[22] Filed: Mar. 4, 1985

[51] Int. Cl.[4] ..... A61G 13/00

[52] U.S. Cl. ..... 269/328; 128/80 R; 128/327

[58] Field of Search ..... 128/80 R, 80 DB, 80 G, 128/80 H, 70, 71, 75, 327, DIG. 20; 269/322, 328

[56] References Cited

U.S. PATENT DOCUMENTS

| | | | |
|---|---|---|---|
| 2,045,750 | 6/1936 | Buschenfeldt | 128/327 |
| 2,465,781 | 3/1949 | Banta | 269/328 |
| 2,934,063 | 4/1960 | Elsasser | 128/71 |
| 3,238,936 | 3/1966 | Siedentop | 128/71 X |
| 4,202,325 | 5/1980 | Villari et al. | 128/DIG. 20 X |
| 4,320,749 | 3/1982 | Highley | 269/328 X |
| 4,331,133 | 5/1982 | Arkans | 128/DIG. 20 X |
| 4,443,005 | 4/1984 | Sugarman et al. | 269/328 |

FOREIGN PATENT DOCUMENTS

| | | | |
|---|---|---|---|
| 2015440 | 11/1971 | Fed. Rep. of Germany | 128/71 |
| 2920394 | 11/1980 | Fed. Rep. of Germany | 269/328 |

OTHER PUBLICATIONS

Title page and p. 11 of an orthopedic brochure entitled "Chick-Langren Orthopedic & Surgical Operating Table, Technique Manual".

Chick, *Chick DV TM Orthopedic & Surgical Operating Table Technique Manual*, 1980.

Chick, *Lottes Anklet*, 7-81.

Medi-Matic, *Medi-Matic Universal Operating Tables OPX500/500E.*

Cyclades, *The Cyclades Range Ortho 701 Attachment.*

Kakinuma, *Operating Table Model K-2800.*

*Maquet Operating Table System 1120.*

*Primary Examiner*—Edgar S. Burr

*Assistant Examiner*—Moshe I. Cohen

*Attorney, Agent, or Firm*—Luke J. Wilburn, Jr.

[57] ABSTRACT

An improved orthopedic attachment for receiving and supportably retaining the lower leg and foot of an orthopedic patient to permit traction to be applied to the leg during orthopedic operating procedures. The orthopedic device comprises a rigid support bracket for attachment to the operating end of a traction crank of an orthopedic operating table. Attached to the bracket is a tubular-shaped cuff member for receiving and surrounding the lower leg of a patient and having a fluid-activated inflatable bladder for grippingly engaging the lower leg to positively retain it therein. Also mounted on the bracket is an adjustable foot support plate which engages and positions the foot relative to the leg of the patient to positively position and retain the same so that traction force can be applied longitudinally of the leg to properly align and hold the bones of the leg in alignment during operating procedures.

9 Claims, 6 Drawing Figures

ORTHOPEDIC SUPPORT DEVICE

The present invention relates to an improved orthopedic support device for retaining the lower portion of the leg and foot of the human body to allow the leg to be placed in an extended position under traction on an orthopedic operating table, as when repositioning, setting and fixing bone fractures of the leg and hip.

BACKGROUND OF THE INVENTION

In orthopedic surgical procedures, it is a practice to employ a special operating table to support the body and extremities of a patient in a desired position. Such operating tables generally include adjustable head, center and foot sections, and movable extension bars or members which have attachments to support and retain the arms and the legs of a patient in desired positions during a particular operatory procedure.

In operatory procedures on the hips and legs of a patient, as in the replacement, repair or pinning of fractures of the hip, or the pinning or casting of realigned bone fractures of the leg, it is a standard practice to place the leg under traction to extend the muscles, and realign and hold the bones in proper position during repair. Typically, this is done by fixing the position of the torso of the patient on the operating table and then applying a traction force to the leg along its longitudinal axis to extend the same. In the past, this has been accomplished by using a fixed vertical post on the operating table located in the crotch between the legs of the patient to hold the lower torso against downward movement, and a foot-retaining member attached to a traction crank of the operating table. The traction crank is mounted on an extension bar of the table and is manually operated to apply a pulling force to the patient's foot to extend the leg from the lower torso and maintain traction thereon for proper bone alignment during the surgical procedure.

In the past, various devices have been employed to position and secure the foot to the traction crank for application of a pulling force to the leg. One such holding device comprises a rigid metal heel cup and foot sole supporting plate attached to the traction crank to receive the patient's foot. The foot of the leg is then secured to the heel cup and sole support plate by a suitable fastening means.

One such fastening means comprises a muslin cloth bandage which is wrapped about the foot and ankle, and tied to the heel cup and sole plate.

Another device for securing the foot and leg to heel cup and foot support plate comprises a flexible reinforced cloth anklet which is strapped about the lower portion of the leg and anklet and is secured to the cup and foot by additional straps.

A more recent development has been the use of a modified form of shoe attached directly by the sole of the shoe to the traction crank. The shoe has an upper portion which receives and is laced about the foot and ankle of the patient.

The use of such foot-retaining traction devices has certain disadvantages and drawbacks. When a cloth muslin bandage is used to tie the foot of a patient to a rigid heel cup and support plate, the bandage can loosen and allow the foot to move in the bandage, resulting in misalignment of the leg. The pressure of the bandage around the arch of the foot also restricts blood circulation to the foot and toes, occasionally requiring interruption of the operatory procedure to loosen the bandage to prevent damage of the foot due to restricted blood flow. In addition, considerable time is required to wrap and tie the muslin bandage around the foot and the heel cup and foot plate in proper position for application of traction to the leg.

With respect to the use of a cloth anklet to secure the foot to the heel cup and foot plate, generally one size is insufficient to fit all size patients, requiring that the anklet be available in multiple sizes for use. Improper securement of the anklet on the foot can cause the foot to slip and become misplaced in the anklet, resulting in misalignment of the leg and improper placement of the same under traction. In addition, time is required to properly secure the anklet around the lower leg and the rigid heel cup and foot plate for application of traction to the leg.

With respect to the modified form of shoe attachment, care must be taken in properly positioning the foot in the shoe and in securing the shoe upper about the foot. On occasion, the foot may bend in the shoe resulting in misalignment of the foot and consequent improper positioning of the leg under traction forces. In addition, pressure of the shoe upper across the top of the foot restricts blood circulation and requires careful monitoring of the patient's foot to avoid possible damage by lack of blood flow thereto.

BRIEF OBJECTS OF THE INVENTION

It is therefore an object of the present invention to provide an improved orthopedic attachment for receiving and supportedly retaining the lower leg and foot of an orthopedic patient to permit traction to be applied to the leg during operating procedures.

It is another object to provide an improved orthopedic device of the type described wherein the lower leg adjacent the ankle is positively retained and secured within an inflatable, adjustable cuff member, and with the foot positively positioned on an adjustable foot plate to retain the leg under traction in proper position during orthopedic operatory procedures.

It is a further object to provide an improved traction device for receiving and supportably retaining the lower leg and foot of an orthopedic patient under traction, and wherein the leg can be positively retained without excess pressure on the foot causing restricted blood flow thereto.

BRIEF SUMMARY OF THE INVENTION

The present invention is directed to an orthopedic attachment device for receiving and supportably retaining the lower leg and foot of an orthopedic patient to permit traction to be applied to the leg of the patient during operating procedures. The support device comprises a rigid support bracket which is attached to the operating end of a traction crank of an orthopedic operating table. Mounted on the support bracket is a tubular-shaped cuff member for surrounding and grippingly retaining the lower leg of the patient adjacent the ankle, and an adjustable foot plate is spaced from the cuff member on the bracket to receive and correctly position the foot relative to the leg. The cuff member has a rigid outer shell containing a fluid-activated inflatable bladder for adjusting the size of the opening through the cuff member to positively grip and secure the lower leg of the patient.

BRIEF DESCRIPTION OF THE DRAWINGS

The above as well as other objects of the present invention will become more apparent, and the invention will be better understood from the following detailed description of preferred embodiments thereof, when taken with the accompanying drawings, in which.

DETAILED DESCRIPTION OF THE PREFERRED EMBODIMENTS

Figure 1:
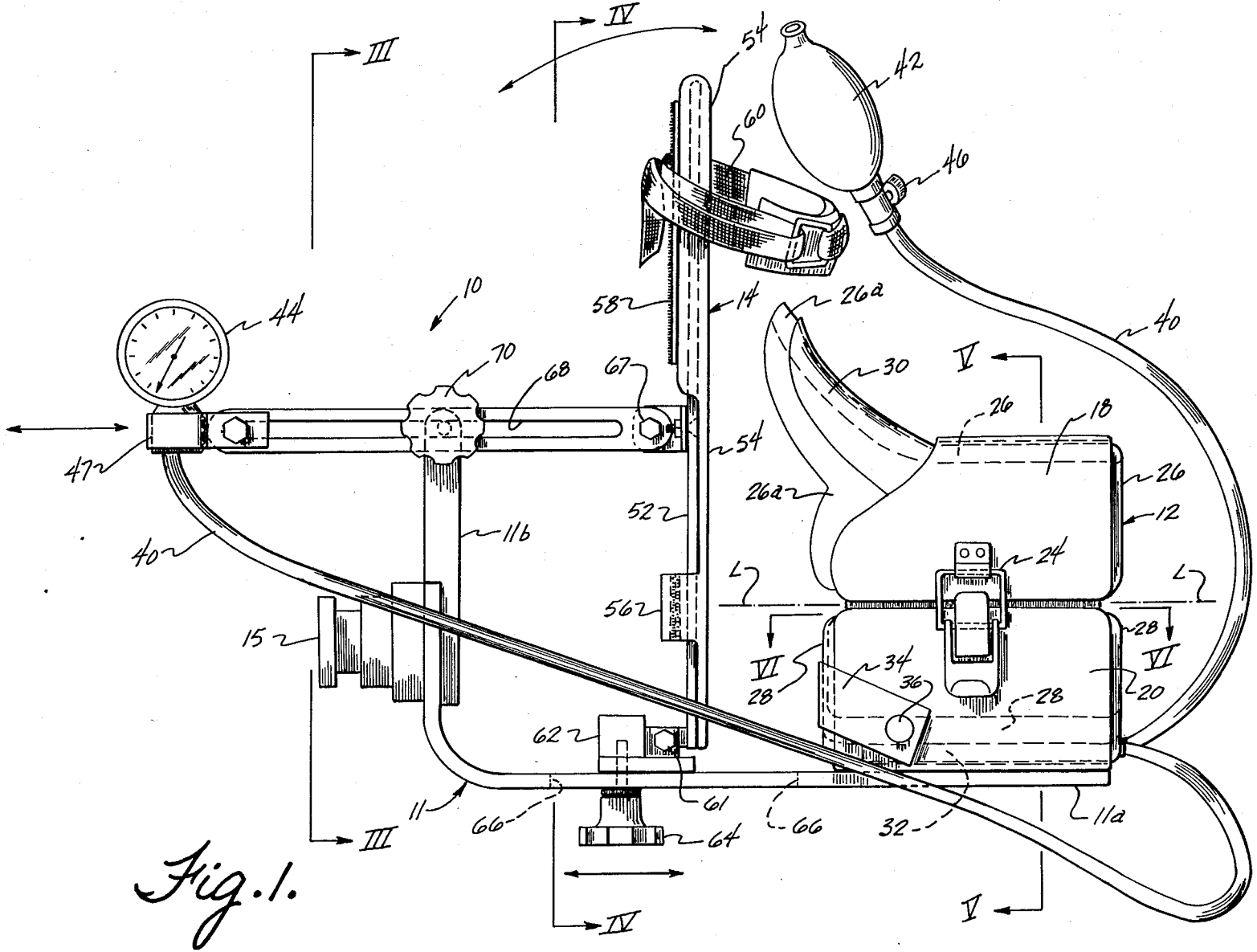
FIG. 1 is a left side elevation view of the orthopedic device of the present invention.

Referring more particularly to the drawings, the orthopedic device 10 of the present invention comprises a generally rigid L-shaped support bracket 11 to which is attached a tubular cuff member 12 and an adjustable foot plate 14. The support bracket is secured to the movable operating end of a conventional orthopedic traction crank (not shown) by a suitable attaching member such as a stub shaft 15 having an axis lying generally on an extension of the longitudinal axis L (FIG. 1) of the passageway through tubular cuff member 12. The traction crank is supported in conventional manner on an adjustable extension support arm of an orthopedic operating table, the construction and operation of which are well known in the art and form no part of the present invention.

As best seen in FIGS. 1, 2, 5 and 6, cuff member 12 is of tubular configuration and has a central passageway therethrough for receiving and retaining the lower leg and ankle of a patient. Cuff member 12 has a rigid outer shell formed of upper and lower semi-circular metal plates 18, 20 pivotably interconnected on one side by a hinge 22 (FIG. 2) and secured in closed relation by a fastening latch 24 (FIG. 1) on the other side to lock the members 18, 20 about the lower leg of a patient. The lower plate 20 is rigidly attached to bracket 11 in suitable manner as by rivots or bolts, not shown. The inside of each of the semi-circular metal plates 18, 20, respectively, contains a cushioning layer 26, 28 of synthetic rubber or the like.

Figure 2:
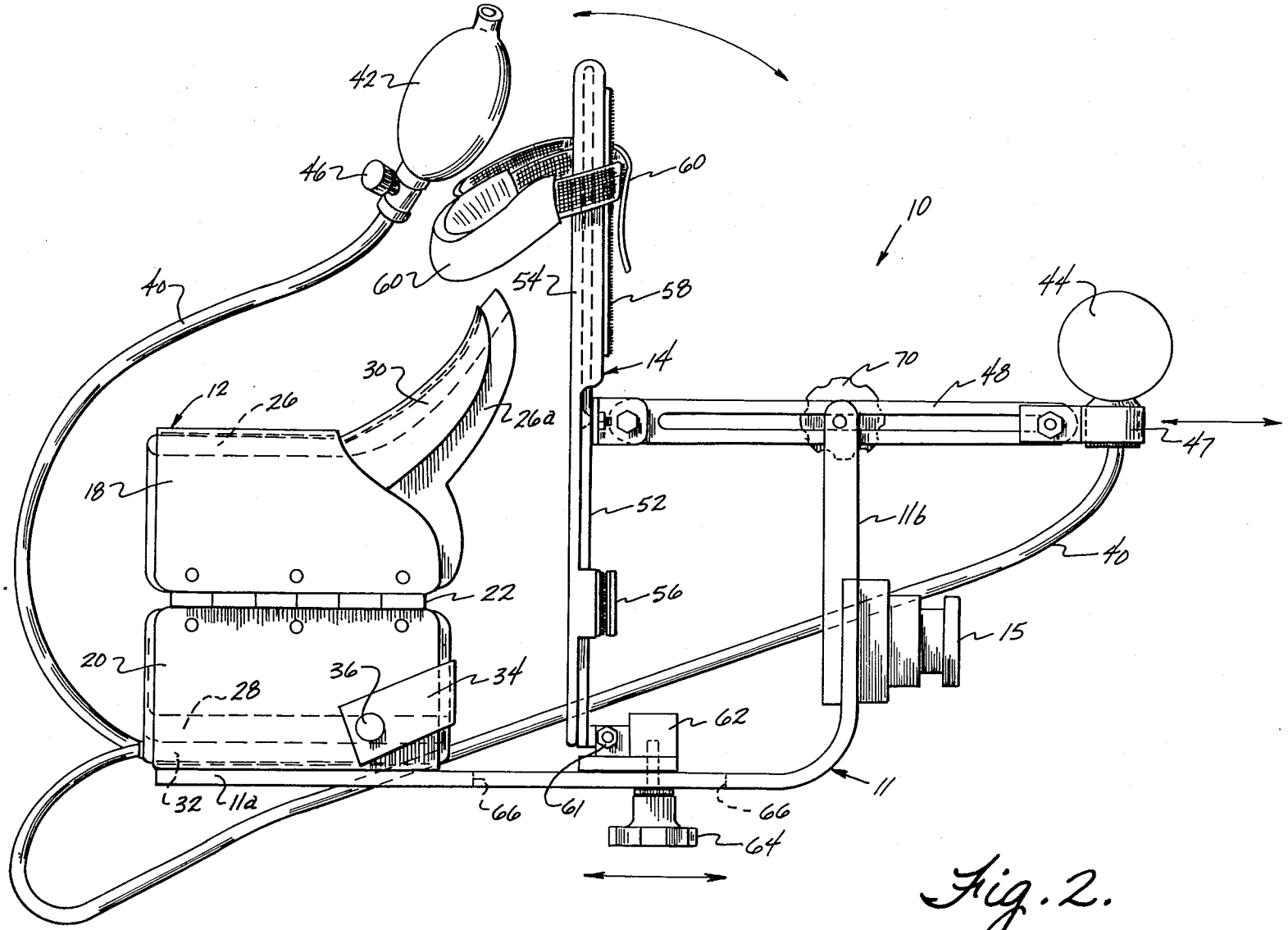
FIG. 2 is a right side elevation view of the device of FIG. 1.
Figure 4:
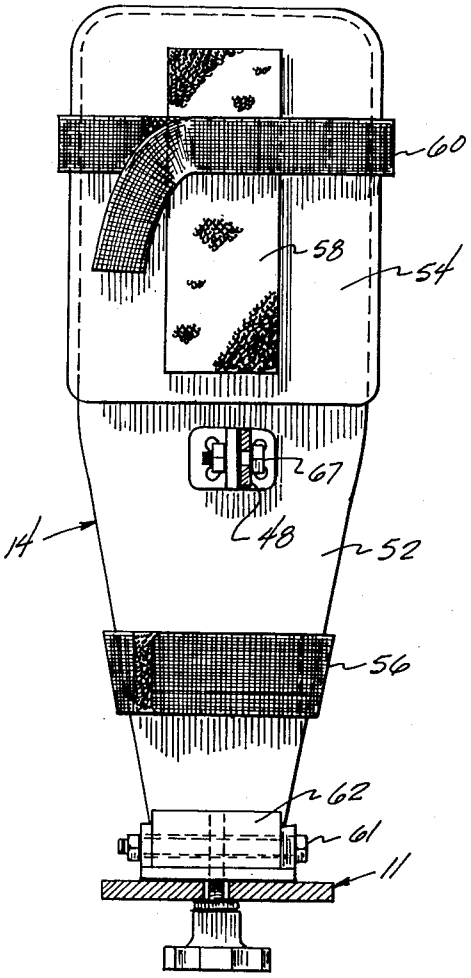
FIG. 4 is a sectional end elevation view taken generally along line IV—IV of FIG. 1 looking in the direction of the arrows, and showing the bottom of the foot plate.
Figure 3:
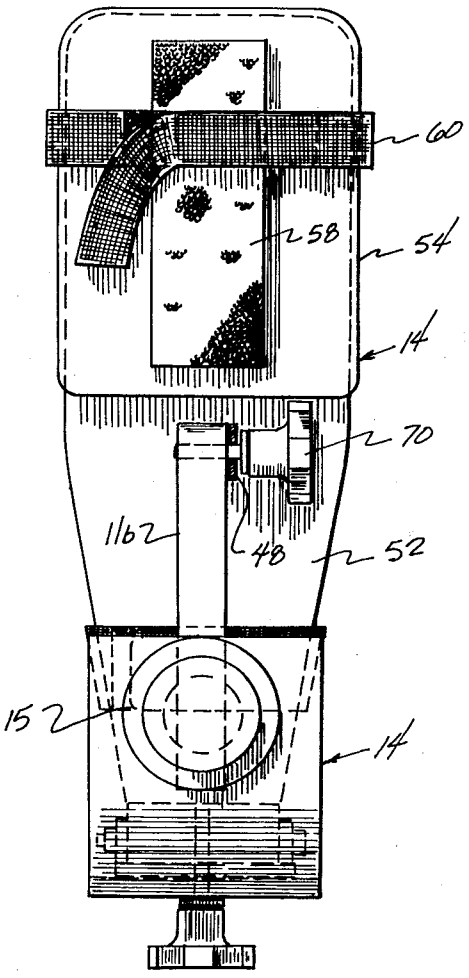
FIG. 3 is a sectional end elevation view taken generally along line III—III of FIG. 1 looking in the direction of the arrows, and showing the bottom of the foot plate of the device.
Figure 5:
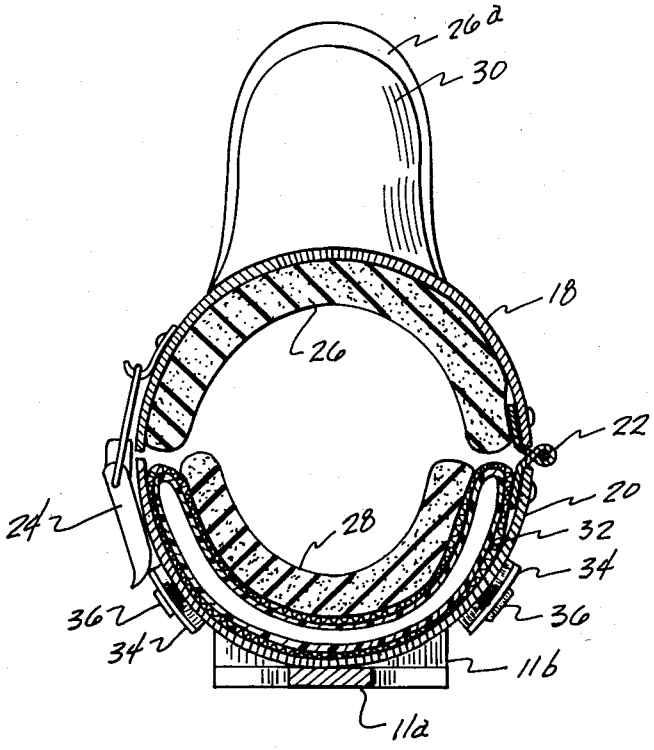
FIG. 5 is a sectional end elevation view taken generally along line V—V of FIG. 1 looking in the direction of the arrows, and showing the cuff member of the device.

As seen in FIGS. 1, 2 and 5, cushion layer 26 inside the upper semi-circular plate 18 has a curved extended portion **26*a* which is backed by a similarly curved flexible, resilient support sheet, such as a sheet of plastic 30 to overlie and protect the upper portion of the top of the foot of a patient when the leg is placed in the cuff member. The upper cushion layer 26 and plastic sheet 30 are secured to the rigid metal plate 18** by an adhesive or other suitable fastening means.

Figure 6:
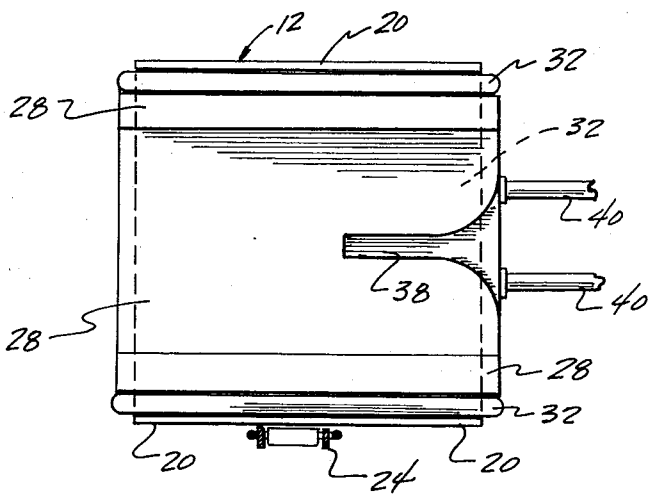
FIG. 6 is a sectional view taken generally along line VI—VI of FIG. 1 looking in the direction of the arrows, and showing the interior of the lower half of the cuff member of the device.

As seen in FIGS. 5 and 6, the lower cushion layer 28 is suitably secured, as by an adhesive, to fluid-actuated expandable and contractable means, such as a fabric-reinforced inflatable rubber bladder 32. The bladder 32 and cushion layer 28 are removably retained in the lower semi-circular plate 20 by two straps 34, the ends of which are secured by snaps 36 to the outer surface of plate 20 (FIGS. 1 and 2). The lower cushion layer 28 has a V-shaped notch or recess 38 to receive the Achilles' tendon portion of the foot of a patient therein.

Communicating by flexible rubber tubing 40 with the interior of the inflatable bladder 32 is a hand-operated rubber air pump 42 and a pressure gauge 44. The air pump 42 is provided with a venting valve 46. The pump, gauge, and bladder are of the general type and construction employed in blood pressure measuring instruments.

Pressure gauge 44 is suitably attached by a fastening bracket 47 to the end of an elongate adjustable slide member 48, the function of which will be explained.

Foot plate 14 is mounted for positional adjustment on support bracket 11 and engages and adjustably positions the foot of a patient when the leg is secured in cuff member 12. As seen in FIGS. 1–4, foot plate 14 includes a rigid metal plantar plate 52 having a cushioned pocket 54 which is slidably received over the upper end of plate 52 and secured thereto by a lower fastening strap 56 having frictional retaining surfaces, such as a Velcro-type fastener. The upper portion of the cushioned pocket 54 is provided on its back face with a Velcro-type fastening strip 58 and an adjustble strap 60 having Velcro-type fastening surfaces is positionally secured therealong to retain the upper portion of the foot of a patient securely against the rigid plantar plate 52.

The lower heel-receiving portion of plantar plate 52 is pivotably attached by a bolt or pivot pin 61 to a movable support block 62. The block 62 has a threaded locking knob 64 which is received through an elongate slot 66 in the lower leg **11*a* of the L-shaped support bracket 11. The slot 62 extends linearly in a direction parallel to the longitudinal axis L of tubular cuff member 12** to permit movement of the heel portion of the plate along the bracket toward and away from the cuff member.

The central portion of plantar plate 52 is pivotably attached by a pin or bolt 67 to one end of the elongate rigid slide member 48 which has an elongate slot 68 therein. Slide member 48 is attached to the upper end of the other leg **11*b* of support bracket 11 by a threaded locking knob 70 which can be tightened and loosened to permit adjustable positioning of the slide member and central portion of the plate 52 along an axis generally parallel to the elongate axis of the tubular cuff member 12**.

It can thus be seen from the foregoing description that foot plate 14, which extends transversely of the longitudinal axis of cuff member 12, may be adjustably positioned by the locking knobs 64 and 70 along slots 66, 68 to support the foot in engagement with the cushioned front surface of foot plate 14 at a desired distance and angle relative to cuff member 12.

In use, the stub shaft 15 of orthopedic device 10 is attached to the operating end of a traction crank which is in turn mounted on a supporting arm of an orthopedic operating table. With a patient lying on the table, and with downward movement of the torso restrained by an upright crotch post positioned between the legs of the patient, the lower leg and foot of the patient are secured in the device 10. With the upper and lower semi-circular plates 18, 20 of the cuff member 12 opened, the leg of the patient is placed in the cuff member and the plates closed and locked about the lower leg just above the ankle. Air pressure is then applied to the inflatable bladder 32 by air pump 42 to firmly grip the leg in the cuff member without restricting blood flow to the foot. The foot plate 14 is then adjustably positioned to engage the sole of the foot and place the foot at a desired angle for securement to the plate by the fastening strap 60.

With the patient properly positioned in the traction device 10 on the table and the torso restrained against downward movement, the traction crank is manually operated to apply pulling force along the longitudinal axis of the tubular cuff member 12 and the leg in sufficient amount to stretch the leg muscles and align any misaligned bones therein in proper position for orthopedic operatory procedures.

The support device of the present invention thus provides positive retention of the leg during the application of traction forces thereto, and correct positioning of the foot without undue pressure being applied to the upper surface of the foot which might restrict blood flow to the toes. By locating the stub shaft 15 of the device generally coincident with and parallel to an extension of the longitudinal axis of the tubular cuff member 12, traction force applied by the traction crank are directed parallel to the longitudinal axis of the leg and bones to maintain proper alignment for orthopedic surgical procedures.

That which is claimed is:

1. An orthopedic device to position and retain the lower portion of the leg and foot of the human body when the leg is placed in an extended position under traction during orthopedic operatory procedures, comprising:

a rigid support bracket;

tubular-shaped cuff means attached to the support bracket for surrounding and grippingly retaining the lower leg of the body adjacent the ankle, said cuff means including fluid-activated means for varying the size of the internal opening through the tubular-shaped cuff means to adjustably grip and retain the lower leg of the body;

foot-positioning means mounted on said support bracket in spaced relation to said cuff means for positioning the foot when the lower leg is located in said cuff means, said foot-positioning means including a plantar plate extending generally transverse to the longitudinal axis of the tubular-shaped cuff means for receiving the sole of the foot, means attaching a heel-receiving portion of the plate to said support bracket for adjustable linear positioning of the heel-receiving portion toward and away from said cuff means along a line generally parallel to the longitudinal axis of the cuff means, means attaching a central portion of the plantar plate to the support bracket for adjustable positioning of the central portion linearly generally parallel to the longitudinal axis of the cuff means;

and means on the bracket for supportably connecting the bracket to a force-applying member of an orthopedic table.

2. A device as defined in claim 1 where in said tubular-shaped cuff means comprises outer rigid circular means for receiving and surrounding the lower leg of the body, cushion means inside the rigid circular means for engaging the lower leg of the body; and wherein said fluid-activated means comprises an inflatable bladder positioned inside the rigid circular means to vary the size of the opening therethrough; and pump means conncected to the bladder to supply fluid to and release fluid from the bladder to expand and collapse the same.

3. A device as defined in claim 2 wherein said pump means comprises a hand-manipulated ball pump, and gauge means connected to the bladder for measuring the fluid pressure therein.

4. A device as defined in claim 2 wherein said rigid circular means comprise first and second semi-circular rigid plates pivotably hinged at one side to open and receive the leg, and fastening means for releasably securing the semi-circular plates in closed position surrounding the leg.

5. A device as defined in claim 1 wherein said support bracket comprises a rigid L-shaped member; said tubular-shaped cuff means is attached to one leg of the L-shaped member with its longitudinal axis extending generally parallel thereto; said means attaching the heel-receiving portion of the plantar plate to the support bracket includes an elongate slot in said one leg of the L-shaped member extending parallel to the longitudinal axis of the cuff means, and means pivotably mounting said heel-receiving portion of the plantar plate to said one leg of the L-shaped member for movement along the slot toward and away from the cuff means; and said means attaching the central portion of the plantar plate to the bracket includes an elongate member pivotably attached to the plantar plate and having an elongate slot therein, and means positioned in said elongate slot for adjustably securing the elongate member to the other leg of the L-shaped member to position the central portion of the foot plate means toward or away from the cuff means generally along thelongitudinal axis thereof.

6. A device as defined in claim 1 wherein said cuff means includes cushion means for grippigly retaining the lower leg of the human body, said cushion means being in surrounding engagement therewith just above the ankle of the leg and having a curved extension for engaging an arch portion of the foot of the human body.

7. A device as defined in claim 6 wherein said cushion means includes a recess for receiving the Achilles' tendon portion of the foot of the human body therein.

8. A device as defined in claim 1 including cushioning means on said plantar plate for engaging the sole of the foot of a body, and adjustable strap means for surrounding the toe end portion of the foot to secure the foot to the cushioned plantar plate.

9. A device as defined in claim 1 wherein said means for connecting the bracket to a force-applying member is located on said bracket generally on an extension of the longitudinal axis of said tubular-shaped cuff means whereby force applied by a force-applying member of an operating table will be directed along said longitudinal axis of the cuff means.

* * * * *